US005086814A

United States Patent [19]

Sato et al.

[11] Patent Number: 5,086,814

[45] Date of Patent: Feb. 11, 1992

[54] DEVICE FOR RELEASING REMAINING GAS IN PRESSURE CAN CONTAINERS AND STORAGE CAP OF THE DEGASSING DEVICE

[75] Inventors: Motohisa Sato; Ichiro Matuda, both of Osaka, Japan

[73] Assignee: Taito Co., Ltd., Osaka, Japan

[21] Appl. No.: 627,938

[22] Filed: Dec. 17, 1990

[30] Foreign Application Priority Data

Jun. 7, 1990 [JP] Japan ..... 2-60503

[51] Int. Cl.[5] ..... B67B 7/24

[52] U.S. Cl. ..... 141/65; 220/89.1; 222/87; 222/83.5; 30/400; 414/412; 141/98; 141/329; 141/51

[58] Field of Search ..... 222/80-83, 222/83.5, 85, 86, 87, 397; 414/412; 30/400-403, 444, 448; 141/51, 65, 329, 330, 311 R, 319, 368, 98; 206/603; 220/277, 212

[56] References Cited

U.S. PATENT DOCUMENTS

| | | | |
|---|---|---|---|
| 2,961,014 | 11/1960 | Applton | 220/277 X |
| 3,042,249 | 7/1962 | Favolise | 220/277 |
| 3,333,735 | 8/1967 | Odasso | 222/82 X |
| 4,349,054 | 9/1982 | Chipman et al. | 141/1 |
| 4,407,341 | 10/1983 | Feldt et al. | 141/97 |
| 4,500,015 | 2/1985 | Penney | 222/83.5 |
| 4,690,180 | 9/1987 | Gold | 141/51 |
| 4,944,333 | 7/1990 | Gold et al. | 141/51 |

FOREIGN PATENT DOCUMENTS

| | | | |
|---|---|---|---|
| 1607991 | 10/1970 | Fed. Rep. of Germany | 141/65 |

*Primary Examiner*—Ernest G. Cusick
*Attorney, Agent, or Firm*—Wenderoth, Lind & Ponack

[57] ABSTRACT

Device for releasing a remaining gas which can easily puncture a hole without involving danger and a cap of a pressure can container which removably stores such a device. The remaining gas releasing device has a flexible sponge plate, a push pin member with its pin portion fitted into the center of one of the surfaces of the sponge plate, a center hole rigid sheet member positioned around the push pin member, a gas-impermeable rigid sheet plate bonded to the surfaces of the center hole rigid plate member, an adhesive sheet plate bonded to the other surface of the sponge plate so that the other surface is covered therewith and having a small hole at its center, and a release sheet plate peelably bonded to the adhesive sheet plate. The cap includes a remaining gas releasing device storage chamber which has a top opening portion disposed towards an outer cylinder portion at part of the top surface of a cap main body, a front opening portion disposed at part of the front surface of the outer cylinder portion, a vertical wall portion therein at a suitable spacing from the top opening portion, and a bottom wall portion extending inwardly from the lower end of the front opening portion.

3 Claims, 2 Drawing Sheets

DEVICE FOR RELEASING REMAINING GAS IN PRESSURE CAN CONTAINERS AND STORAGE CAP OF THE DEGASSING DEVICE

BACKGROUND OF THE INVENTION

1. Field of the Invention

This invention relates to a remaining gas releasing device used for releasing a gas remaining inside pressurized can containers such as spray cans for cosmetics, combustible gas cans, aerosol cans for spraying an insecticide, and the like, and also to a cap for removably storing such a device.

2. Description of the Prior Art

Generally, various kinds of spray cans and combustible gas cans are regarded as pressurized or pressure containers and they have found a wide application in cosmetics, insecticides, portable gas ranges, and so forth.

When these pressure can containers are discarded, they involve hazards of fire and explosion and eventually, injury and burning of the human body. Therefore, caution notices are put on these pressure can containers to the effect that they should be discarded after having been punctured and any gas remaining therein released.

However, no household tool capable of easily releasing the remaining gas in the pressure can containers has been available conventionally and a hole is formed, for example, by driving a nail into the can with a hammer.

Accordingly, there is the problem that this puncturing is extremely troublesome and, moreover, there is another problem that the remaining gas gushes out onto the face and hands of the person driving the nail the instant that the hole is opened and is extremely dangerous.

The present invention intends to solve such problems. In other words, the present invention contemplates providing a device for releasing remaining gas which can easily bore a hole without involving danger and a cap of a pressure can container which removably stores such a device.

SUMMARY OF THE INVENTION

In order to accomplish the object described above, the present invention provides a remaining gas releasing device which comprises an open-cell, compressible and flexible sponge plate having a disc-like or arbitrary polygonal shape and a predetermined thickness; a push pin member having a head plate portion and disposed with its pin portion fitted into the center of one of the surfaces of the sponge plate; a center hole rigid sheet member positioned around the outer periphery of the head plate portion of the push pin member on one of the surfaces of the sponge plate, and having the same thickness as that of the head plate portion; a gas-impermeable rigid sheet plate bonded to the surfaces of the center hole rigid plate member and the head plate portion by an adhesive in such a manner that the center hole rigid plate member and the head plate portion are covered therewith; an adhesive sheet plate bonded in such a manner that the other surface of the sponge plate is covered therewith and having a small hole at its center; and a release sheet plate peelably adhered to the adhesive sheet plate.

The present invention also provides a cap for pressure can containers which comprises a remaining gas releasing device storage chamber and a remaining gas releasing device stored in the remaining gas releasing device storage chamber, wherein the remaining gas releasing device chamber comprises a top opening portion disposed towards an outer cylinder portion at part of the top surface of a cap main body and having a size such that the remaining gas releasing device can be put into or taken out therethrough; a front opening portion disposed at part of the front surface of the outer cylinder portion so as to continue from the top opening portion and having such a size as to prevent pulling out of the remaining gas releasing device; a vertical wall portion disposed in the cap main body suitably spaced from the front opening portion; and a bottom wall portion disposed in the cap main body and extending from the lower end of the front opening portion; and wherein said remaining gas releasing device comprises an open-cell, compressible and flexible sponge plate, a push pin member equipped with a head plate portion and having a pin portion inserted toward the back surface from the center of the front surface of the compressible flexible sponge plate; and a gas-impermeable rigid sheet plate disposed on the front surface of the head plate portion of the push pin member and on the front surface of the compressible flexible sponge plate.

The remaining gas releasing device of pressure can containers in accordance with the present invention is used in the following way. First of all, the compressible sponge plate is brought into contact with a suitable portion, preferably an upper portion, of the pressure can container with the gas-impermeable rigid sheet plate facing the front. Next, the gas-impermeable rigid sheet plate is pushed against the pressure can container with a finger and the open-cell foamable, compressible and flexible sponge plate is compressed flexibly and the pin portion of the inner push pin member sticks into the pressure can container, thereby boring a hole in the pressure can container. The pushing operation is stopped the instant that this hole is made. Then, the open-cell compressible and flexible sponge plate is restored to its uncompressed shape and absorbs the remaining gas spouting through the hole described above. The jet force of the gas is thus reduced inside the open cells of the compressible flexible sponge plate and is dispersed and emitted in the radial direction of the sponge plate. In addition, there is no harm to the user because the gas-impermeable rigid sheet plate prevents spraying of the gas onto the user.

The cap of the pressure can containers in accordance with the present invention is used normally as the lid of the pressure can container. When the pressure can container is to be discarded after its contents have been used up, however, the remaining gas releasing device stored in the remaining gas releasing device storage chamber of the cap main body is taken out therefrom.

BRIEF DESCRIPTION OF THE DRAWINGS

The accompanying drawings show an embodiment of the present invention, wherein.

DETAILED DESCRIPTION OF THE PREFERRED EMBODIMENT

Hereinafter, the present invention will be described with reference to a preferred embodiment thereof shown in the accompanying drawings.

Figure 1:
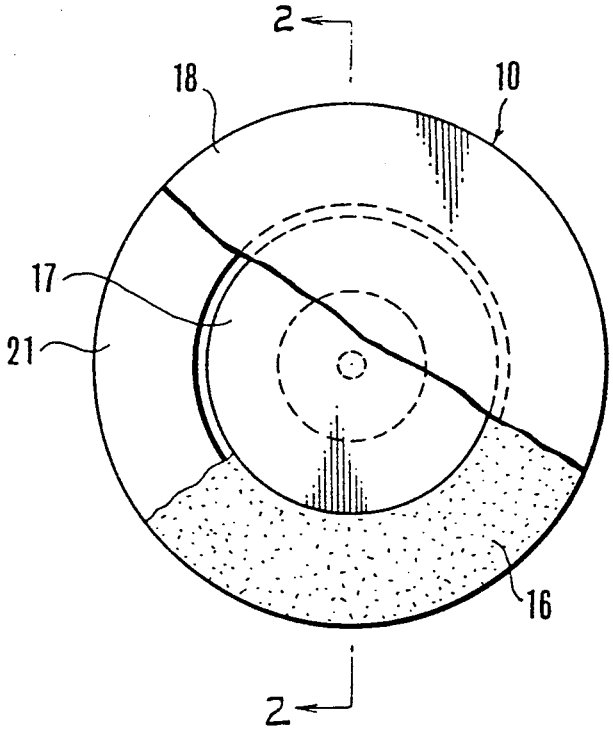
FIG. 1 is a partially cut-away front view showing a remaining gas releasing device according to the invention.
Figure 2:
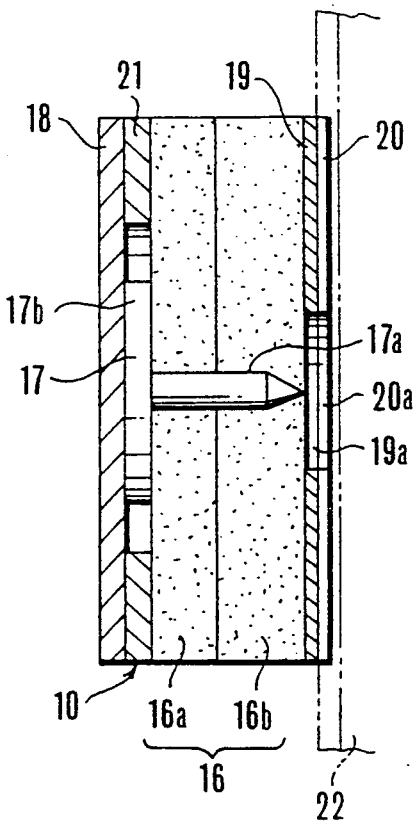
FIG. 2 is a sectional view taken along line 2—2 of FIG. 1.
Figure 3:
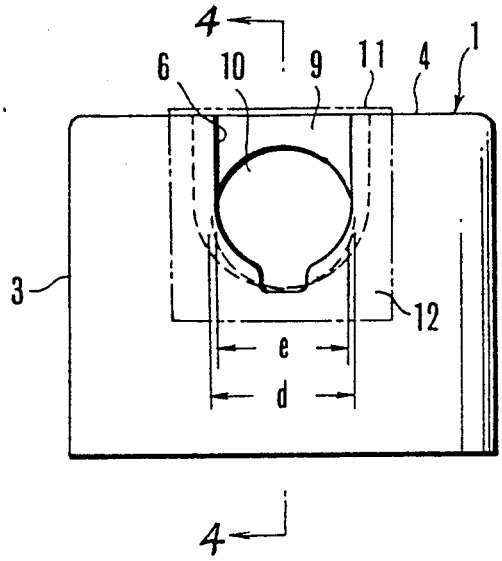
FIG. 3 is a front view of a cap for a pressurized can according to the present invention.
Figure 4:
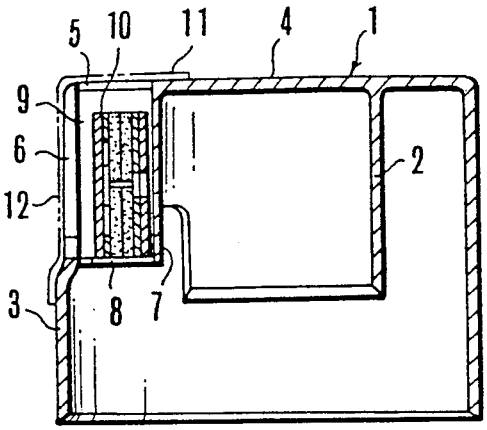
FIG. 4 is a sectional side view taken along line 4—4 of FIG. 3.

In FIGS. 1 and 2, reference numeral 16 designates a circular, open-cell and compressible flexible sponge plate having a predetermined thickness; 17 designates a push pin member; 18 designates a gas-impermeable effect sheet plate; 19 is a double-face adhesive sheet plate; 20 designates a release sheet plate; and 21 is a center hole rigid plate member.

The flexible sponge plate 16 consists of a considerably hard layer 16*a* made of foamed polyethylene, for example, on the side toward the head plate portion 17*b* of the push pin member 17 and a considerably soft layer 16*b* made of foamed polyurethane, for example, on the side toward the double-face adhesive sheet plate 19.

The push pin member 17 made of metal, for example, is disposed at the center of the surface of the flexible sponge plate 16 in such a manner that its pin portion 17*a* having a length somewhat smaller than the thickness of the sponge plate 16 extends through it.

The rigid sheet plate 18 is bonded to the surfaces of the head plate portion 17*b* and center hole rigid plate member 21 by an adhesive in such a manner as to cover the head plate portion 17*b* of the push pin member 17 and the center hole rigid sheet member 21.

The double-face adhesive sheet plate 19 is adhered so as to cover the back of the sponge plate 16 and has a small hole 19*a* at its center.

The release sheet plate 20 is adhered peelably to the adhesive sheet plate 19 and has a small hole 20*a* at its center.

The center hole rigid plate member 21 is positioned around the outer periphery of the head plate portion 17*b* of the push pin member 17 and on the surface of the sponge plate 16 described above and has the same thickness as that of the head plate portion 17*b*.

In this embodiment, the considerably hard layer 16*a* of the compressible flexible sponge plate 16 has a greater restoring force than the considerably soft layer 16*b* and the rigid sheet plate 18 is colored red, for example, lest the user of the device mistake the upper side for the lower side. Small holes 19*a* and 20*a* are disposed in the double-face adhesive sheet plate 19 and in the release sheet plate 20, respectively.

FIGS. 3–6 show an embodiment of the cap of the present invention. In the drawings, reference numeral 1 designates a cap main body; 2 designates its inner cylinder portion; 3 designates its outer cylinder portion; 4 designates its top surface; 5 designates a top opening portion which is disposed at part of the top surface 4 close to the outer cylinder portion and has a size permitting transferring of the above described releasing device or the like therethrough; 6 designates a front opening portion which is disposed at part of the front surface of the outer cylinder portion 3 and has a size to prevent pulling out of the gas releasing device therethrough; 7 designates a vertical wall portion disposed within the main body suitably spaced from the front opening portion 6; 8 designates a bottom wall portion disposed at the lower end of the front opening portion 6; 9 designates a remaining gas releasing device storage chamber; 10 designates the remaining gas releasing device; 11 designates a cover which covers the top surface opening portion 5 and is disposed so as to be peelable from outside of the main body; and 12 designates a cover member which covers the front opening portion 6 and is disposed so as to be peelable from outside of the main body.

Figure 5:
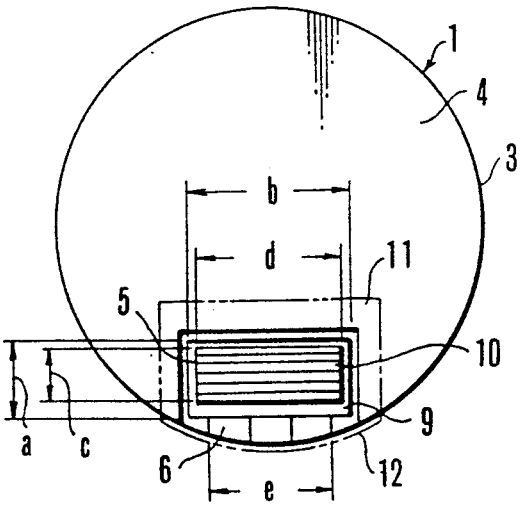
FIG. 5 is a plan view thereof.
Figure 6:
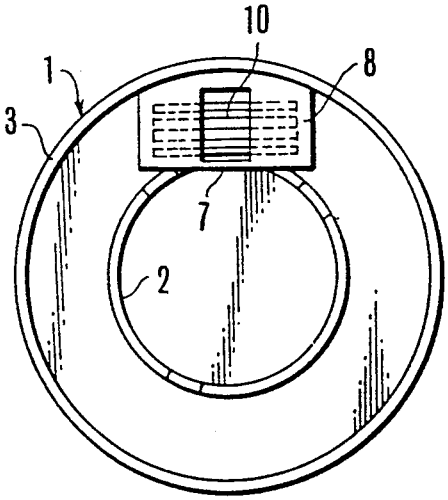
FIG. 6 is a bottom view thereof.

In this embodiment, the top opening portion 5 has a depth a and a width b, the remaining gas releasing member has a disc-like shape having a thickness c and a diameter d and the front opening portion 6 has a width e, as shown in FIG. 5. These dimensions are in the relations $a>c$, $b>d>e$, whereby the remaining gas releasing device 10 can be put into and taken out through the top opening portion 5 in the vertical direction but is prevented from being pulled out through the front opening portion 6.

The cap of the pressure can container constituted as shown in FIGS. 3–6 is normally used as the cap of the pressure can container. However, when the pressure can container is to be discarded after its contents have been used up, the remaining gas releasing device 10 stored in the remaining gas releasing device storage chamber 9 is taken out after the cover members 11 and 12 are peeled off the cap main body 1.

As to the use of the remaining gas releasing device, after the releasing device is placed in the cap of the container during the production process of the pressure can container, the container is sold with the remaining gas releasing device. To use the remaining gas releasing device, the user takes the remaining gas releasing device out of the cap main body, peels off the release sheet plate 20, arranges the rigid sheet plate 18 to face either upward or front-wise and then bonds the double-face adhesive sheet plate 19 to a suitable position such as on the side surface of an upper portion of the pressure can container 22.

Next, the rigid sheet plate 18 is pushed towards the pressure can container 22 by a finger of the user. Then, the open-cell, compressible flexible sponge plate 16 undergoes flexible compression and the pin portion 17*a* of the push pin member 17 inside penetrates into the pressure can container 22, puncturing a hole in it. The instant that this hole is opened, the finger is released to stop pushing and the open-cell, compressible flexible sponge plate 16 is restored to its uncompressed condition and at the same time, absorbs the remaining gas spurting through the hole. The jet force of this gas is reduced inside the open-cells of the flexible sponge plate 16 and is dispersed and emitted in the radial direction of this sponge plate 16. Since the gas-impermeable rigid sheet plate 18 prevents the gas from being sprayed onto the body of the user, there is no danger.

In the embodiment described above, the remaining gas releasing device 10 is disc-like as can be seen from FIG. 1, but it may have an arbitrary polygonal shape. Furthermore, the cover member 11 of the top opening portion 5 may be replaced by a removable cover. Still further, if the tip of the pin portion 17*a* of the push pin member 17 of the remaining gas releasing device 10 is dangerous, it is desirable that a hard cover for covering the outer periphery of the remaining gas releasing device 10 be put on the outer surface of the release sheet plate 20 and the remaining gas releasing device 10 is stored in the remaining gas releasing device storage chamber 9. In this case, however, the dimensions c and d in FIG. 3 must be made greater by the size of the cover put thereon. A notice describing that the remaining gas releasing device 10 is stored in the cap main body and instructions for its use are preferably put on the cover member 12 of the front opening portion 6.

The gas releasing device in accordance with the present invention incorporates the push pin member and the open-cell, compressible flexible sponge plate thereinside, the gas impermeable rigid sheet plate on the front surface, the release sheet plate on the back thereof and the adhesive sheet plate between the flexible sponge plate and the release sheet plate. Therefore, when the gas releasing device is used for releasing the remaining gas, the release sheet plate is peeled off, first of all, to expose the adhesive sheet plate. Since this adhesive sheet plate has the small hole at its center, the user can bond it to the upper portion of the pressure can container without mistaking the front for the back. When the user pushes the gas-impermeable rigid sheet plate toward the pressure can container with his finger, the compressible flexible sponge plate undergoes flexible compression and the pin portion of the push pin member thereinside penetrates into the pressure can container and a hole can thus be punctured easily in the pressure can container. The instant that this hole is formed, the pushing operation is stopped. Then, the compressible flexible sponge plate is restored to its uncompressed condition and absorbs the remaining gas spouting through the hole. The jet force of this gas is reduced inside the open-cells of the flexible sponge plate and is dispersed and emitted in the radial direction of the sponge plate. On the other hand, since the gas-impermeable rigid sheet plate prevents the gas from being sprayed onto the body of the user, there is no danger and safety is insured. The center hole rigid sheet member having the same thickness as the heat sheet portion of the push-pin member is disposed at the outer periphery of the head sheet portion on one of the surfaces of the sponge plate and the gas-impermeable rigid sheet is bonded to it. Accordingly, unlike the case where the rigid sheet plate is bonded directly onto one of the surfaces of the sponge plates, the peripheral portion of the rigid sheet plate is sufficiently bonded to the rigid sheet member, so that the rigid sheet plate is prevented from being pushed up directly by the sponge plate during storage, or the like. For this reason, the peripheral portion of the rigid sheet plate does not peel from the rigid sheet member.

In the cap of the present invention, the remaining gas releasing device is stored by utilizing the dead space between the lower surface of the top surface of the cap main body and the corners of the outer cylinder portion. Therefore, even when pressure can containers of the type having a push plate for pushing a spray head for communicating an injection pipe with spray liquid, the cap does not at all impede this function and does not cause any problem during the normal use as a cap.

Moreover, since the remaining gas releasing device is stored in the remaining gas releasing device storage chamber of the cap main body, it is always stored at a predetermined position and will neither be lost nor missed. When the pressure can container is to be discarded after its contents have been used up, the stored remaining gas releasing device can be taken out through the top opening portion.

What is claimed is:

1. A remaining gas releasing device for releasing gas remaining in pressurized can containers, comprising:

an open-cell, compressible and flexible sponge plate having a predetermined thickness and shape and opposite surfaces;

a push pin member having a head plate portion with opposite surfaces and a pin portion extending from one surface thereof into the center of one of the surfaces of said sponge plate;

a center hole rigid sheet member positioned around the outer periphery of said head plate portion of said push pin member with one surface thereof on said one of the surfaces of said sponge plate, and having the same thickness as that of said head plate portion;

a gas-impermeable rigid sheet plate adhered to the other surface of said center hold rigid plate member and said head plate portion and covering said center hole rigid plate member and said head plate portion;

an adhesive sheet plate bonded to the other surface of said sponge plate and having a small hole at its center; and a release sheet plate peelably adhered to said adhesive sheet plate.

2. A cap for a pressurized can container, comprising:

a cap main body having a top surface and an outer cylinder portion;

a remaining gas releasing device storage chamber; and a remaining gas releasing device stored in said remaining gas releasing device storage chamber;

said remaining gas releasing device storage chamber comprising:

a top opening portion disposed toward the outer cylinder portion of the cap main body at part of the top surface of said cap main body and having a size for permitting said remaining gas releasing device to be put into or taken out therethrough;

a front opening portion disposed at part of the front surface of said outer cylinder portion and extending downwardly from said top opening portion and having a size for preventing said remaining gas releasing device from being removed therethrough;

a vertical wall portion within said cap main body at a predetermined spacing from said front opening portion; and a bottom wall portion within said cap main body and extending from the lower end of said front opening portion;

said remaining gas releasing device comprising:

an open-cell, compressible and flexible sponge plate having front and back surfaces;

a push pin member having a head plate portion having front and back surfaces and a pin portion extending from the back surface into said sponge plate toward the back surface thereof from the center of the front surface thereof; and a gas-impermeable rigid sheet plate disposed on the front surface of said head plate portion of said push pin member and on the front surface of said sponge plate.

3. A cap as claimed in claim 2 further comprising a cover member covering said top opening portion and said front opening portion from the outside of said storage chamber.

* * * * *